US009554426B2

(12) United States Patent
Oh et al.

(10) Patent No.: US 9,554,426 B2
(45) Date of Patent: Jan. 24, 2017

(54) INDUCTION HEAT COOKING APPARATUS AND METHOD FOR CONTROLLING OUTPUT LEVEL THEREOF

(71) Applicant: LG ELECTRONICS INC., Seoul (KR)

(72) Inventors: Dooyong Oh, Seoul (KR); Heesuk Roh, Seoul (KR); Byeongwook Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 462 days.

(21) Appl. No.: 14/145,484

(22) Filed: Dec. 31, 2013

(65) Prior Publication Data

US 2014/0183184 A1 Jul. 3, 2014

(30) Foreign Application Priority Data

Jan. 2, 2013 (KR) ..... 10-2013-0000084

(51) Int. Cl.
*H05B 6/04* (2006.01)
*H05B 6/36* (2006.01)
*H05B 6/06* (2006.01)

(52) U.S. Cl.
CPC ..... *H05B 6/065* (2013.01)

(58) Field of Classification Search
CPC ..... H05B 6/04; H05B 6/06; H05B 6/062; H05B 6/065; H05B 6/02; H05B 6/101; H05B 6/1236; H05B 6/1272; H05B 6/1281
USPC ..... 219/660, 661, 662, 670, 671, 620, 624,219/625, 626, 675, 664, 672
See application file for complete search history.

(56) References Cited

U.S. PATENT DOCUMENTS

| | | | | |
|---|---|---|---|---|
| 4,210,792 | A | 7/1980 | Higuchi et al. | |
| 4,356,371 | A | 10/1982 | Kiuchi et al. | |
| 5,329,100 | A | 7/1994 | Lee | 219/626 |
| 5,490,450 | A | 2/1996 | Lee | 99/337 |
| 5,951,904 | A | 9/1999 | Jung et al. | 219/626 |
| 6,528,770 | B1 | 3/2003 | Akel et al. | 219/624 |
| 2007/0268729 | A1 | 11/2007 | Choi et al. | |

(Continued)

FOREIGN PATENT DOCUMENTS

| | | | |
|---|---|---|---|
| EP | 0 986 287 | | 3/2000 |
| JP | 3-263788 A | * | 11/1991 |

(Continued)

OTHER PUBLICATIONS

European Search Report issued in related Application No. 13199745.4 dated Jul. 3, 2014.

(Continued)

*Primary Examiner* — Hung D Nguyen
(74) *Attorney, Agent, or Firm* — KED & Associates, LLP

(57) ABSTRACT

Provided is an induction heat cooking apparatus. The induction heat cooking apparatus includes a rectifying part rectifying an input voltage to output a DC voltage, an inverter switching the DC voltage outputted through the rectifying part to generate an AC voltage, a first heating part operated by the AC voltage applied from the inverter, a second heating part connected to the first heating part in parallel, the second heating part being operated by the AC voltage applied from the inverter, and a switching signal generation part controlling an operation state of each of the first and second heating parts from the inverter according to an operation mode inputted from the outside. The switching signal generation part includes a photo coupler.

16 Claims, 4 Drawing Sheets

(56) References Cited

U.S. PATENT DOCUMENTS

| | | | |
|---|---|---|---|
| 2012/0152935 | A1 | 6/2012 | Kitaizumi et al. |
| 2012/0321761 | A1 | 12/2012 | De La Cuerda Ortin |

FOREIGN PATENT DOCUMENTS

| | | | |
|---|---|---|---|
| JP | 2010-140657 A | * | 6/2010 |
| WO | WO 2012/114405 | | 8/2012 |

OTHER PUBLICATIONS

European Office Action dated Jan. 29, 2016 issued in Application No. 13199745.4.
U.S. Office Action dated May 16, 2016 issued in co-pending U.S. Appl. No. 14/145,357.
U.S. Office Action dated May 16, 2016 issued in co-pending U.S. Appl. No. 14/145,428.
European Search Report dated Oct. 17, 2016 issued in Application No. 131997.9.
Jung, Yong-Chae: "Dual half bridge series resonant inverter for induction heating appliance with two loads", Electronics Letters; IEE Stevenage, GB, vol. 35, No. 16; Aug. 5, 1999 (Aug. 5, 1999), pp. 1345-1346, XP006012499, ISSN: 0013-5194, DOI: 10.1049/EL:19990926.
European Search Report dated Dec. 5, 2016 issued in Application No. 13199755.3.

* cited by examiner

INDUCTION HEAT COOKING APPARATUS AND METHOD FOR CONTROLLING OUTPUT LEVEL THEREOF

CROSS-REFERENCE TO RELATED APPLICATIONS

The present application claims priority under 35 U.S.C. §119 to Korean Patent Application No. 10-2013-0000084 filed on Jan. 2, 2013, whose entire disclosure is hereby incorporated by reference in its entirety.

BACKGROUND

1. Field

The present disclosure relates to an induction heat cooking apparatus, and more particularly, to an induction heat cooking apparatus including an inverter, which is constituted by three switching devices, and two resonant circuits and a method for controlling an output level thereof.

2. Background

Induction heat cooking apparatuses having inverters are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

In general, induction heat cooking apparatuses are electrical cooking apparatuses in which high-frequency current flows into a heating element (e.g., working coil or heating coil), and thus eddy current flows while a strong magnetic flux generated due to the flowing of the high-frequency current passes through a cooking container to heat the container itself, thereby performing a cooking function.

According to a fundamental heating principle of such an induction heat cooking apparatus, as current is applied to the heating coil, heat is generated in the cooking container that is a magnetic substance by induction heating. Thus, the cooking container itself may be heated by the generated heat to perform the cooking function.

An inverter used in the induction heat cooking apparatus serves as a switching device for switching a voltage applied to the heating coil so that the high-frequency current flows into the heating coil. The inverter may operate a switching device constituted by a general insulate gate bipolar transistor (IGBT) to allow high-frequency current to flow into the heating coil, thereby generating high-frequency magnetic fields around the heating coil.

When two heating coils are provided in the induction heat cooking apparatus, two inverters are needed to operate the two heating coil at the same time. Also, although the two heating coils are provided in the induction heat cooking apparatus, if one inverter is provided, a separate switch may be provided to selectively operate only one of the two heating coils.

Figure 1:
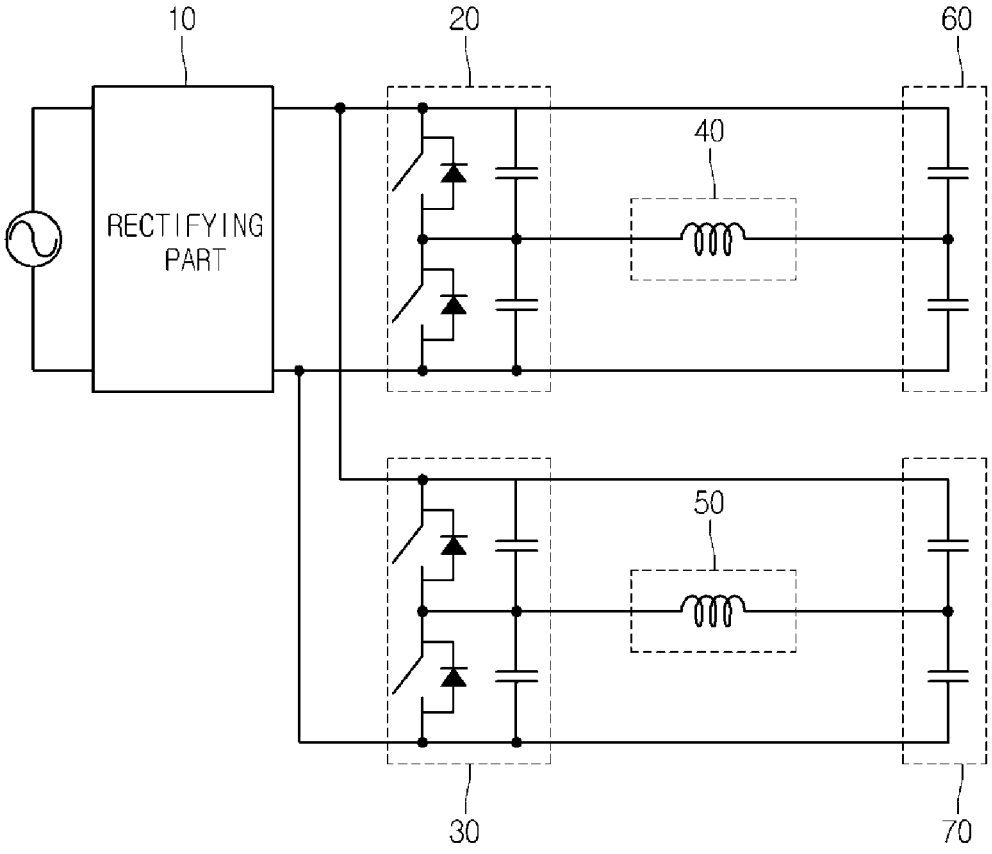
FIG. 1 is a view of an induction heat cooking apparatus according to one embodiment.

FIG. 1 is a view of an induction heat cooking apparatus according to one embodiment. Here, the induction heat cooking apparatus includes two inverters and two heating coils.

Referring to FIG. 1, an induction heat cooking apparatus includes a rectifying part 10, a first inverter 20, a second inverter 30, a first heating coil 40, a second heating coil 50, a first resonant capacitor 60, and a second resonant capacitor 70.

The first and second inverters 20 and 30 are respectively connected to switching devices for switching input power in series. The first and second heating coils 40 and 50 operated by an output voltage of each of the switching devices are respectively connected to contact points of the switching devices that are respectively connected to the first and second heating coils 40 and 50 in series. Also, the first and second heating coils 40 and 50 have the other sides respectively connected to the resonant capacitors 60 and 70.

The operation of each of the switching devices may be performed by a driving part. A switching time outputted from each of the driving parts may be controlled to apply a high-frequency voltage to the heating coils while the switching devices are alternately operated. Since a closing/opening time of the switching device applied from the driving part is controlled to gradually compensate the closing/opening time, a voltage supplied into each of the heating coils may be converted from a low voltage to a high voltage.

The induction heat cooking apparatus should include two inverter circuits to operate the two heating coils. Thus, one disadvantage in this embodiment is that the product may increase in volume as well as price due to multiple inverter circuits that are required.

Figure 2:
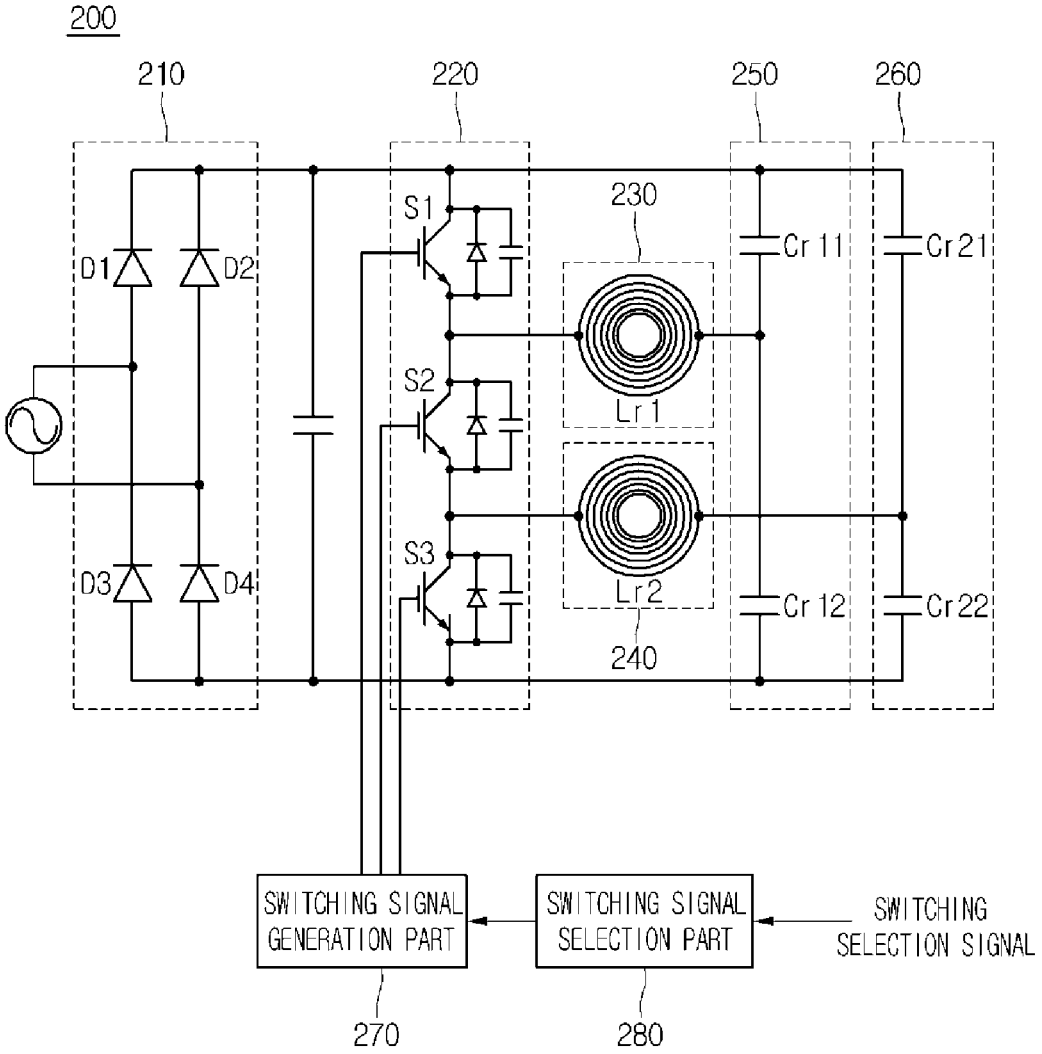
FIG. 2 is circuit diagram of an induction heat cooking apparatus according to an embodiment.

FIG. 2 is circuit diagram of an induction heat cooking apparatus according to an embodiment.

Referring to FIG. 2, an induction heat cooking apparatus 200 includes a rectifying part 210 receiving a commercial power AC from the outside to rectify the received commercial power into a DC voltage, an inverter 220 (S1, S2, and S3) connected between a positive power terminal and a negative power terminal in series to switch the terminals according to a control signal, thereby providing a resonant voltage, a first heating coil 230 connected to an outer terminal of the inverter 220, a second heating coil 240 connected to the output terminal of the inverter 220 and connected to the first heating coil 230 in parallel, a first resonant capacitor 230 connected to an outer terminal of the first heating coil 230 and including a plurality of capacitors connected to each other in parallel, a second resonant capacitor 260 connected to an output terminal of the second heating coil 240 and including a plurality of capacitors connected to each other in parallel, a switching signal generation part 270 supplying a switching signal into each of switches S1, S2, and S3 provided in the inverter 220 according to an operation mode, and a switching signal selection part 280 receiving a switching selection signal from the outside to select a switching signal to be generated in the switching signal generation part 270 according to the switching selection signal, thereby outputting the selected switching signal to the switching signal generation part 270.

In FIG. 2, an unexplained capacitor may represent a smoothing capacitor. The smoothing capacitor may allow a pulsating DC voltage rectified in the rectifying part 210 to be smooth, thereby generate a constant DC voltage.

Hereinafter, a connection relationship between the components included in the induction heat cooking apparatus will be described.

The rectifying part 210 includes a first rectifying part D1, a second rectifying part D2, a third rectifying part D3, and a fourth rectifying part D4.

The first rectifying part D1 and the third rectifying part D3 are connected to each other in serial. The second rectifying part D2 and the fourth rectifying part D4 are connected to each other in series.

The inverter 220 includes a plurality of switches. In the current embodiment, the inverter 220 may include a first switch S1, a second switch S2, and a third switch S3.

The first switch S1 has one end connected to the positive power terminal and the other end connected to an end of the second switch S2.

The second switch S2 has one end connected to the other end of the first switch S1 and the other end connected to one end of the third switch S3.

The third switch S3 has one end connected to the other end of the second switch S2 and the other end connected to the negative power terminal.

The first heating coil 230 has one end connected to a contact point between the other end of the first switch S1 and one end of the second switch S2 and the other end connected to the plurality of capacitors included in the first resonant capacitor 250 (Cr11 and Cr12).

The second heating coil 240 has one end connected to a contact point between the other end of the second switch S2 and one end of the third switch S3 and the other end connected to the plurality of capacitors included in the second resonant capacitor 260 (Cr21 and Cr22).

The first heating coil 230 and the first resonant capacitor 250 constitute a first resonant circuit to serve as a first burner. The second heating coil 240 and the second resonant capacitor 260 constitute a second resonant circuit to serve as a second burner.

An anti-parallel diode is connected to each of the switches S1, S2, and S3 included in the inverter 220. Also, an auxiliary resonant capacitor parallely connected to the anti-parallel diode for minimizing a switching loss of each of the switches is connected to the each of the switches S1, S2, and S3.

The switching signal generation part 270 is connected to a gate terminal of each of the first, second, and third switches of the inverter 220. Thus, the switching signal generation part 270 outputs a gate signal for controlling a switching state of each of the first, second, and third switches S1, S2, and S3.

The gate signal may be a switching signal for determining the switching state of each of the first, second, and third switches S1, S2, and S3.

The switching signal generation part 270 will be described below with reference to FIG. 3.

The switching signal selection part 280 receives a switching selection signal from the outside to select an operation mode of the induction heat cooking apparatus 200 according to the received switching selection signal, thereby outputting a control signal for determining a state of a switching signal to be generated in the switching signal generation part 270 according to the selected operation mode.

The switching signal selection part 280 may receive the signal for respectively or simultaneously operating the first and second heating coils 230 and 240. The switching signal selection part 280 may output a control command with respect to a switching operation signal to be generated in the switching signal generation part 270 on the basis of the inputted signal.

Figure 3:
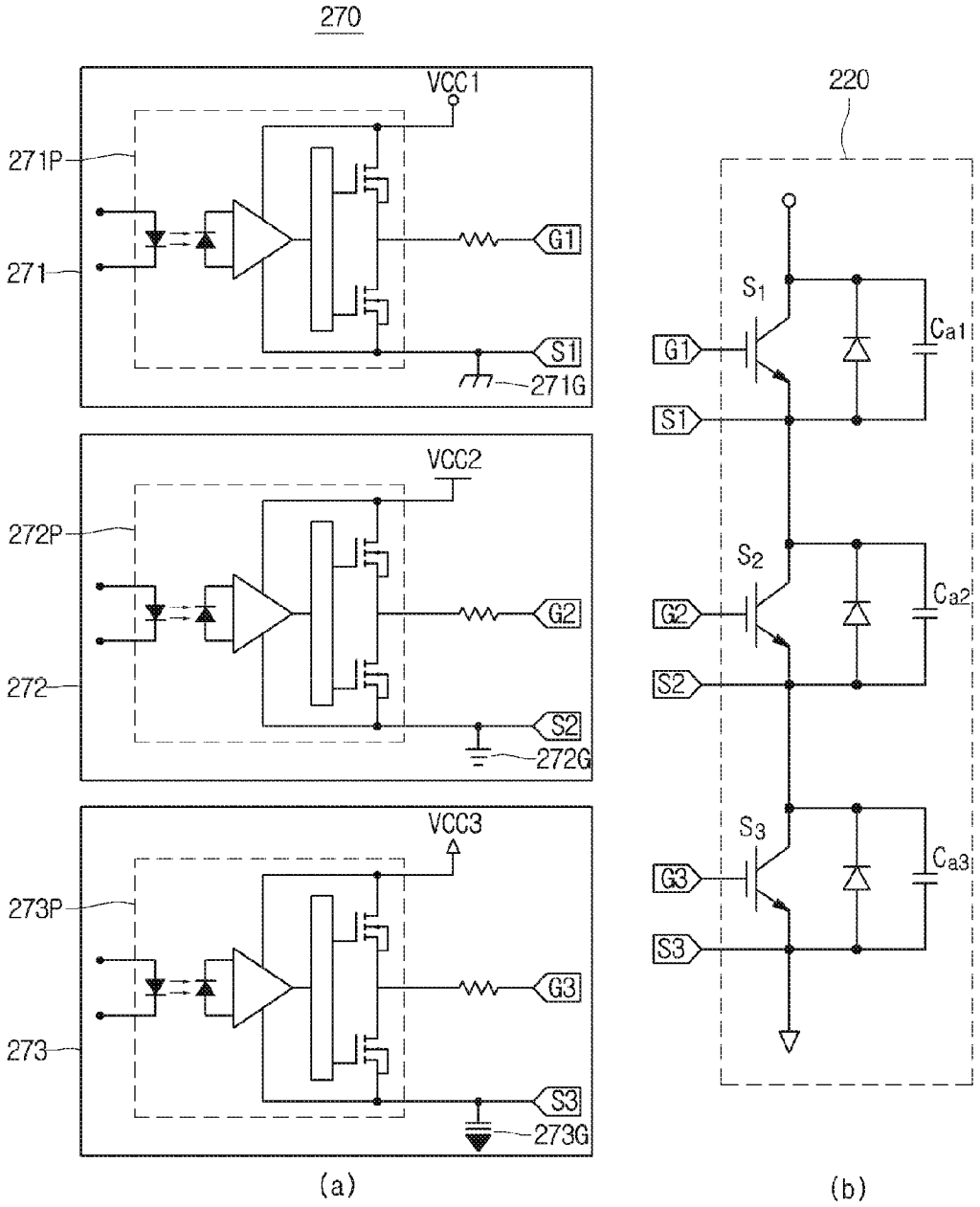
FIG. 3 is a circuit diagram of a switching signal generation part and an inverter according to an embodiment.

FIG. 3 is a detailed circuit diagram of a switching signal generation part and an inverter according to an embodiment.

Referring to FIG. 3, the switching signal generation part 270 (or switching signal generator) may include a gate circuit including photo-couplers 271P, 272P, and 273P (also optocoupler, opto-isolator) to respectively correspond to the switches so that a switching control signal is applied to each of the plurality of switches S1, S2, and S3 constituting the inverter 220.

As shown in FIG. 3(*b*), the switching signal generation part 270 may include gate circuit parts 271, 272, and 273 including the photo couplers 271P, 272P, and 273P, control power applying parts Vcc1, Vcc2, and Vcc3 (also control power/voltage node or terminal), and GND 271G, 272G, and 273G (also ground node or terminal) to respectively correspond to the switches so that the three switches S1, S2, and S3 of the inverter 220 constituted by a dual half bridge circuit are independently controlled. The gate circuit parts 271, 272, and 273 may include a first gate circuit 271, a second gate circuit 272, and a third gate circuit 273 to generate switching signals for controlling the three switches according to an embodiment.

The first to third gate circuit parts 271 and 273 may include the control power applying parts Vcc1, Vcc2, and Vcc3, and the GND 271G, 272G, and 273G which are different from each other, respectively. Each of the photo couplers 271P, 272P, and 273P which are respectively provided in the gate circuit parts 271, 272, and 273 may include a light emitting part and a light receiving part and be electrically insulated with respect to each other. Each of the photo couplers 271P, 272P, and 273P may emit light when a control power is applied to a light emitting diode. Also, when the light is incident into a photo transistor for receiving light, each of the photo couplers 271P, 272P, and 273P may be in a conduction state. Thus, when the control power is applied to the control power applying parts Vcc1, Vcc2, and Vcc3 respectively corresponding to the photo couplers 271P, 272P, and 273P, the photo couplers 271P, 272P, and 273P may be in the conduction state. As a result, the switching signal may be applied to the corresponding switches S1, S2, and S3 according to an operation request signal of each of the heating coils applied from the switching signal selection part 280.

Here, the second gate circuit part 272 may output the control signal to continuously close or open the second switch S2 of the inverter 220 according to the operation request signal of each of the heating coils inputted from the switching signal selection part 280.

That is, when an exclusive operation signal (a first operation mode) of the first heating coil 230 is inputted, the switching signal generation part 270 may close the first and second switches S1 and S2. Thus, the first and second gate circuit parts 271 and 272 may be in the conduction state. As a result, the first resonant circuit 250 may be operated to operate the first heating coil 230.

Also, when an exclusive operation signal (a second operation mode) of the second heating coil 240 is inputted, the second and third switches S2 and S3 are closed, and the first switch S1 is opened. Thus, the second and third gate circuit parts 272 and 273 may be in the conduction state. As a result, the second resonant circuit 260 may be operated to operate the second heating coil 240.

Also, when a simultaneous operation signal (a third operation mode) of the first and second heating coils 230 and 240 is inputted, the first and third switches S1 and S3 are closed, and the second switch S2 is continuously opened. Thus, the first and third gate circuit parts 271 and 273 may be in the conduction state. As a result, the first and second resonant circuits 250 and 260 may be operated to operate the first and second heating coils 230 and 240 at the same time.

Also, when an alternate operation signal (a fourth operation mode) of the first and second heating coils 230 and 240 is inputted, the first and third switches S1 and S3 are alternately closed, and the second switch S2 is continuously closed. Thus, the first and third gate circuit parts 271 and 273 may be in an alternate conduction state, and the second gate circuit part 272 may be in a continuous conduction state. Thus, the first and second resonant circuits 250 and 260 may be alternately operated to successively and alternately operate the first and second heating coils 230 and 240.

As described above, the switching signal generation part 270 including the gate circuit part including the photo couplers respectively corresponding to the switches to operate the dual half bridge inverter including the three switches was described according to an embodiment. An operation of the induction heat cooking apparatus according to an embodiment will be described by using the above-described components with reference to FIG. 4.

Figure 4:
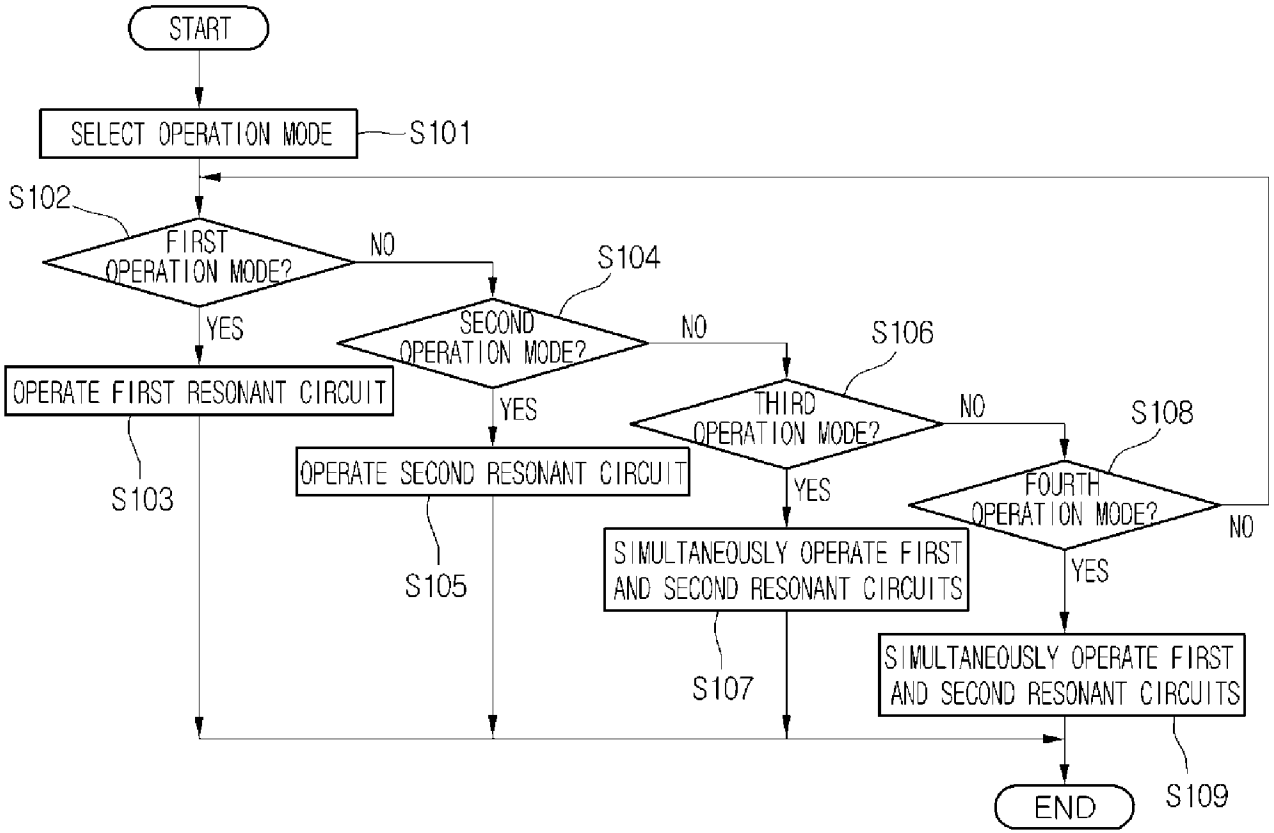
FIG. 4 is a flowchart illustrating an operation of the induction heat cooking apparatus according to an embodiment.

FIG. 4 is a flowchart illustrating an operation of the induction heat cooking apparatus according to an embodiment.

Referring to FIG. 4, a switching signal selection part 280 may receive an operation mode selection signal from the outside (S101).

The switching signal selection part 280 may determine whether an operation mode selection signal inputted from the outside is a first operation mode for operating the first heating coil 230 (S102).

If the first operation mode for operating the first heating coil 230 is selected, the switching signal selection part 280 may output a corresponding signal to a switching signal generation part 270. Thus, the switching signal generation part 270 controls the first to third switches S1 to S3 included in the inverter 220 to close the first and second switches S1 and S2 and open the third switch S3. The photo couplers 271P and 272P of the first and second gate circuit parts 271 and 272 may be in the conduction state to operate only the first coil and the first resonant circuit (S103).

As the determination result (S102), if an operation request signal of the first heating coil 230 is not inputted, the switching signal selection part 280 may determine whether an operation request signal of the second heating coil 240 is inputted (S104).

If a second operation mode for operating the second heating coil 240 is selected, the switching signal selection part 280 may output a corresponding signal to the switching signal generation part 270. The switching signal generation part 270 controls the first to third switches S1 to S3 included in the inverter 220 to close the second and third switches S2 and S3 and open the first switch S1. The photo couplers 272P and 273P of the second and third gate circuit parts 272 and 273 may be in the conduction state to operate only the second heating coil and the second resonant circuit (S105).

As the determination result (S104), if an operation request signal of the second heating coil 240 is not inputted, the switching signal selection part 280 may determine whether a third operation mode for operating the first and second heating coils 230 and 240 at the same time is selected (S106).

If the third operation mode is selected, the switching signal selection part 280 may output a corresponding signal to the switching signal generation part 270. The switching signal generation part 270 may control the first to third switches S1 to S3 included in the inverter 220 to close the first and third switch S1 and S3 and open the second switch S2. Each of the first and third gate circuit parts 271 may be in the conduction state, and the second gate circuit part 272 may be in an insulation state. Thus, only the first heating coil and the first resonant circuit and the second heating coil and the second resonant circuit may be operated (S107).

As the determination result (S106), if a third operation mode for the first and second heating coils 230 and 240 at the same time is not inputted, the switching signal selection part 280 may determine whether a fourth operation mode for alternately operating the first and second heating coils 230 and 240 is selected (S108).

If the fourth operation mode is selected, the switching signal selection part 280 may output a corresponding signal to the switching signal generation part 270. The switching signal generation part 270 may control the insulation and conduction of the gate circuit so that the corresponding switch and resonant circuit are operated according to an operation order of the first and second heating coils 230 and 240.

That is, when the first heating coil 230 is operated first, the first and second gate circuit parts 271 and 272 may be controlled in the conduction state to close the first and second switches S1 and S2. Also, the third gate circuit 273 may be controlled in the insulation state to open the third switch S3, thereby operating the first heating coil 230. When the operation period of the first heating coil 230 is finished, the operation of the first heating coil 230 may be finished to operate the second heating coil 240. Thus, the first gate circuit part 271 of the first and second gate circuit parts 271 and 272 may be converted from the conduction state into the insulation state. Also, the third gate circuit part 273 may be converted into the conduction state to close the second and third switches S2 and S3 and open the first switch S1.

As described above, the first and second heating coils may be alternately operated according to the opening and closing of each of the switches depending on the insulation and conduction states of each of the gate circuit parts.

According to the embodiments, since the plurality of heating coils are operated by using only the one inverter including the three switching devices, the induction heat cooking apparatus may be simplified in circuit and reduced in volume to reduce product unit costs.

Also, according to the embodiments, the circuit for operating the plurality of heating coils at the same time by using only the one inverter may be provided to improve user satisfaction.

Embodiments provide an induction heat cooking apparatus including a constitution for generating a gate voltage that operates two resonant circuits by using an inverter including three switches.

The feature of the inventive concept is not limited to the aforesaid, but other features not described herein will be clearly understood by those skilled in the art from descriptions below.

In one embodiment, an induction heat cooking apparatus includes: a rectifying part rectifying an input voltage to output a DC voltage; an inverter switching the DC voltage outputted through the rectifying part to generate an AC voltage; a first heating part operated by the AC voltage applied from the inverter; a second heating part connected to the first heating part in parallel, the second heating part being operated by the AC voltage applied from the inverter; and a switching signal generation part controlling an operation state of each of the first and second heating parts from the inverter according to an operation mode inputted from the outside, wherein the switching signal generation part includes a photo coupler.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heat cooking apparatus comprising:

a rectifier that rectifies an input voltage to output a DC voltage;

an inverter that includes a first switch a second switch, and a third switch to switch the DC voltage outputted from the rectifier to generate an AC voltage, the first, second switch, and third switches each having first and second connection leads and being serially connected;

first and second resonant capacitors coupled in parallel;

a first heating element having a first connection to a node between the second connection lead of the first switch and the first connection lead of the second switch and a second connection to the first resonant capacitor;

a second heating element having a first connection to a node between the second connection lead of the second switch and the first connection lead of the third switch and a second connection to the second resonant capacitor; and a switching signal generator that generates control signals for the inverter to control an operational state of each of the first and second heating elements according to a received operational mode signal, wherein the switching signal generator includes a photo-coupler.

2. The induction heat cooking apparatus according to claim 1, wherein each of the first, the second, and the third switches includes an anti-parallel diode and a resonant capacitor connected in parallel to the anti-parallel diode.

3. The induction heat cooking apparatus according to claim 1, wherein the switching signal generator includes a plurality of gate circuits that correspond to respective ones of the first, the second, and the third switches of the inverter, each of the gate circuits including the photo-coupler, a control power node, and a ground node.

4. The induction heat cooking apparatus according to claim 3, wherein a voltage between the control power node and the ground node in each of the gate circuits is different than each other.

5. The induction heat cooking apparatus according to claim 3, wherein the switching signal generator controls the photo-coupler of each of the first to third gate circuits to be in an insulation or conduction state according to the received operational mode signal for each of the heating elements.

6. The induction heat cooking apparatus according to claim 5, wherein, when the operational mode signal is a signal for operating only the first heating element, the switching signal generator controls the photo-coupler of each of the first and second gate circuits to be in the conduction state and the photo-coupler of the third gate circuit to be in the insulation state to close the first and second switches and open the third switch.

7. The induction heat cooking apparatus according to claim 5, wherein, when the operational mode signal is a signal for operating only the second heating element, the switching signal generator controls the photo-coupler of each of the second and third gate circuits to be in the conduction state and the photo-coupler of the first gate circuit to be in the insulation state to close the second and third switches and open the first switch.

8. The induction heat cooking apparatus according to claim wherein, when the operational mode signal is a signal for operating both the first and second healing elements, the switching signal generator controls the photo-coupler of each of the first and third gate circuits to be in the conduction state and the photo-coupler of the second gate circuit to be in the insulation state to close the first and third switches and open the second switch.

9. An induction heat cooking apparatus comprising:

a rectifier that rectifies an input voltage to output a DC voltage;

an inverter that includes a first switch, a second switch, and a third switch to switch the DC voltage outputted from the rectifier to generate an AC voltage, the first, second switch, and third switches each having first and second connection leads and being serially connected;

first and second resonant capacitors coupled in parallel;

a first heating element having a first connection to a node between the second electrode of the first switch and the first connection lead of the second switch and a second connection to the first resonant capacitor;

a second heating element having a first connection to a node between the second connection lead of the second switch and the first connection lead of the third switch and a second connection to the second resonant capacitor; and a switching signal generator that generates control signals for the inverter to control an operational state of each of the first and second heating elements according to a received operational mode signal, wherein the switching signal generator includes a photo-coupler for generating the control signals to the respective switches, and wherein the first connection lead of the first switch and the second connection lead of the third switch are connected to the first and second resonant capacitors.

10. The induction heat cooking apparatus according to claim 9, wherein each of the first, the second, and the third switches includes an anti-parallel diode and a resonant capacitor connected in parallel to the anti-parallel diode.

11. The induction heat cooking apparatus according to claim 9, wherein the switching signal generator includes a plurality of gate circuits that correspond to respective ones of the first, the second, and the third switches of the inverter, each of the gate circuits including the photo-coupler, a control power node, and a ground node.

12. The induction heat cooking apparatus according to claim 11, wherein a voltage between the control power node and the ground node in each of the gate circuits is different than each other.

13. The induction heat cooking apparatus according to claim 11, wherein the switching signal generator controls the photo-coupler of each of the first, the second, and the third gate circuits to be in an insulation state or a conduction state according to the received operational mode signal for each of the first and the second heating elements.

14. The induction heat cooking apparatus according to claim 13, wherein, when the operational mode signal is a signal for operating only the first heating element, the switching signal generator controls the photo-coupler of each of the first and second gate circuits to be in the conduction state and the photo-coupler of the third gate circuit to be in the insulation state to close the first and second switches and open the third switch.

15. The induction heat cooking apparatus according to claim 13, wherein, when the operational mode signal is a signal for operating only the second heating element, the switching signal generator controls the photo-coupler of each of the second and third gate circuits to be in the conduction state and the photo-coupler of the first gate circuit to be in the insulation state to close the second and third switches and open the first switch.

16. The induction heat cooking apparatus according to claim 13, wherein, when the operational mode signal is a signal for operating both the first and second heating elements, the switching signal generator controls the photo-coupler of each of the first and third gate circuits to be in the conduction state and the photo-coupler of the second gate circuit to be in the insulation state to close the first and third switches and open the second switch.

* * * * *